US005393151A

United States Patent [19]

Martin et al.

[11] Patent Number: 5,393,151

[45] Date of Patent: Feb. 28, 1995

[54] PRINT MEDIUM HANDLING SYSTEM INCLUDING COCKLE RIBS TO CONTROL PEN-TO-PRINT MEDIUM SPACING DURING PRINTING

[75] Inventors: Paul W. Martin, Battle Ground; Cathy A. Rotering, Camas; Mark S. Hickman; Chris Lesniak, both of Vancouver, all of Wash.

[73] Assignee: Hewlett-Packard Company, Palo Alto, Calif.

[21] Appl. No.: 203,152

[22] Filed: Feb. 28, 1994

Related U.S. Application Data

[63] Continuation-in-part of Ser. No. 71,417, Jun. 3, 1993, Pat. No. 5,356,229.

[51] Int. Cl.[6] ..... B41J 13/14

[52] U.S. Cl. ..... 400/642; 400/646

[58] Field of Search ..... 400/642, 646, 648, 656, 400/611, 617, 578, 624, 619, 126, 55, 56, 59; 346/140, 134; 271/188, 209

[56] References Cited

U.S. PATENT DOCUMENTS

| | | | |
|---|---|---|---|
| 3,673,960 | 7/1972 | Ricci et al. | 101/269 |
| 3,915,281 | 10/1975 | Blomquist et al. | 197/114 |
| 3,995,730 | 12/1976 | Kwan et al. | 197/127 |
| 4,095,686 | 6/1978 | Okabe | 400/150 |
| 4,537,521 | 8/1985 | Rekewitz et al. | 400/637 |
| 4,549,826 | 10/1985 | Stoeberl | 400/826 |
| 4,560,292 | 12/1985 | Takahashi | 400/59 |
| 4,642,661 | 2/1987 | Dean, II | 346/153.1 |
| 4,728,963 | 3/1988 | Rasmussen et al. | 346/25 |
| 4,843,338 | 6/1989 | Rasmussen et al. | 400/55 |
| 4,853,255 | 8/1989 | Onishi et al. | 427/148 |
| 5,065,169 | 11/1991 | Vincent et al. | 340/140 |
| 5,280,897 | 1/1994 | Maekawa | 271/209 |
| 5,291,224 | 3/1994 | Asano et al. | 346/134 |

*Primary Examiner*—Edgar S. Burr
*Assistant Examiner*—Anthony H. Nguyen

[57] ABSTRACT

A printer mechanism to control pen-to-print medium spacing during printing is described. The preferred embodiment of the mechanism includes a printhead and an adjacent platen, the printhead and the platen defining a print zone therebetween. The platen includes ribs adapted for contacting a lower surface of the print medium such that the print medium bends downwardly between the ribs, thereby reducing uncontrolled bending of the print medium in the print zone. The ribs preferably extend parallel to a direction of travel of the print medium and may be positioned adjacent a transition zone, the transition zone facilitating a smooth transition of a leading edge of the print medium onto the ribs.

9 Claims, 4 Drawing Sheets

PRINT MEDIUM HANDLING SYSTEM INCLUDING COCKLE RIBS TO CONTROL PEN-TO-PRINT MEDIUM SPACING DURING PRINTING

This application is a continuation-in-part of application Ser. No. 08/071,417, filed Jun. 3, 1993, now U.S. Pat. No. 5,356,229, entitled PRINT MEDIUM HANDLING SYSTEM TO CONTROL PEN-TO-PRINT MEDIUM SPACING DURING PRINTING and subject to common ownership herewith.

TECHNICAL FIELD

The present invention relates generally to pen-to-print medium spacing during printing in a wet ink printer. More particularly, the invention concerns an apparatus including cockle ribs to force the print medium into a controlled curve such that the apparatus reduces uncontrolled bending of the print medium in a print zone, the print zone positioned adjacent the wet-ink printer pen.

BACKGROUND ART

Typically ink-jet printers, or any printers using wet ink, include a printhead, a print zone positioned adjacent the printhead, a feed mechanism for feeding a print medium through the print zone, and a platen positioned adjacent the print zone, the platen guiding and supporting the print medium in the print zone during printing.

During printing, ink is placed on the print medium by dropping or ejecting ink from the printhead, or by any other printing method well known by those skilled in the art. Ink used in wet ink-type printing includes a relatively large amount of water. As the wet ink contacts the print medium, the water in the ink saturates the fibers of the print medium, causing the fibers to expand, which in turn causes the print medium to buckle. Buckling, also called cockling, of the print medium tends to cause the print medium either to uncontrollably bend downwardly away from the printhead, or to uncontrollably bend upwardly toward the printhead. In either case, a constant pen-to-print medium spacing is not achieved, leading to poor print quality. Additionally, upwardly buckling print medium may contact a pen nozzle in the printhead, leading to ink smearing on the print medium.

Typically, to achieve good print quality, pen-to-print medium spacing of less than 1.5 millimeters (mm), and preferably less than 1.0 mm, is required. However, bending amplitudes of print medium in certain pen/ink combinations can be greater than 3 mm. To reduce this problem of paper buckling, which varies the pen-to-print medium spacing, various shaped platens were designed.

The Hewlett-Packard Deskjet (a trademark of Hewlett-Packard) printer includes a platen with a flat print medium contacting surface and a feed mechanism, usually a drive roller, positioned adjacent the platen. The flat expanse of the platen is positioned below the printhead such that the platen supports the print medium throughout a print zone defined between the printhead and the platen. The feed mechanism is positioned such that print medium is fed at a downward angle onto the platen such that the print medium is concavely curved relative to the printhead in an initial region of a print zone. This small region of concave curvature generally does not extend under the pen nozzles of the printhead.

Thus, during low ink density printing, the print medium does not buckle and merely lies flat against the contacting surface of the platen throughout the print zone. However, during high ink density printing, the print medium buckles. The flat platen prevents the print material from buckling downwardly away from the printhead and so the print medium is forced to buckle upwardly toward the printhead. Thus, the Deskjet device does not adequately ensure proper pen-to-print medium spacing. In addition, the device increases the risk of ink smearing due to possible pen-to-print medium contact when the print material buckles upwardly.

The Hewlett-Packard Paintjet XL (a trademark of Hewlett-Packard) printer includes the elements of the Deskjet printer, but also includes a second drive roller positioned adjacent an exit area of the print zone. Print media are fed downwardly onto the platen from the feed mechanism, or first drive roller, extend throughout the print zone, and then travel over the second drive roller, such that the print medium is positioned between the second drive roller and an adjacent star wheel. The second drive roller is positioned generally above the platen such that the first drive roller and the second drive roller effect a generally concave curve in the print medium relative to the printhead, throughout the print zone. Because the print medium is gripped between a paper guide and the first drive roller on one side of the printhead, and between the second drive roller and a star wheel on another side of the printhead, the sheet of print medium is held in a controlled curve throughout the print zone. This controlled curve ensures proper pen-to-print medium spacing during printing, thereby ensuring good quality printing. However, inclusion of the second drive roller in the Paintjet XL printer increases the cost and complexity of the printer. Also, the possibility of ink smearing is increased because the star wheel contacts the freshly printed print medium as it presses the print medium against the second drive roller. Additionally, intake problems can arise when sheets of print media are improperly fed between the second drive roller and the star wheel.

The Hewlett-Packard Designjet (a trademark of Hewlett-Packard) printer includes a driver roller positioned beneath a printhead, the drive roller acting as a rotating platen. Sheets of print media are fed through a print zone defined between the drive roller and the printhead. The sheets are held in contact with the curved outer surface of the drive roller by a paper guide positioned adjacent the roller on one side of the printhead, and by a star wheel positioned adjacent the drive roller on the other side of the printhead. In this arrangement, print medium is held in a generally convexly shaped curve relative to the printhead throughout the print zone. However, due to the curved surface of the drive roller, the print zone in such Designjet printers must be relatively narrow to achieve an acceptable pen-to-print medium spacing. For example, a drive roller having a radius of 31.75 mm (1.25-inches) ensures adequate print medium bending control, but would require a small print zone, and therefore a short printing array of ink nozzles in the printhead. A 12.70 mm (0.5-inch) printing array, for example, in combination with a 31.75 mm (1.25-inches) radius roller would result in a 0.63 mm (0.02-inch) change in pen-to-print medium spacing due to the drive roller curvature alone. Additionally, the possibility of ink smearing is increased due to the star wheel contacting the freshly printed medium as it forces the medium against the surface of the drive roller.

The parent application of this continuation-in-part application describes a printhead, a platen, a print zone defined between the printhead and the platen and a feed mechanism, such as a drive roller, positioned adjacent an entrance area of the print zone. The platen includes a generally flat expanse and an inclined region, the inclined region including an edge which contacts the underside of the print medium along a line of contact. The feed mechanism feeds a sheet into the print zone preferably downwardly toward the platen such that the sheet contacts the platen along a line of contact. Thus, the print medium, or print material, is suspended in a generally concavely shaped curve relative to the printhead between the feed mechanism and between the line of contact, the line of contact being positioned along the flat region or in the inclined region depending on the stage of printing. Once the leading edge of the sheet is downstream of the top edge of the inclined region, the leading edge of the print material is unsupported, such that the print material can buckle downwardly, away from the printhead, avoiding the problem of ink smearing. Typically, the inclined region edge is positioned generally adjacent a print zone exit region such that the print material is concavely curved relative to the printhead generally throughout the print zone, and is convexly curved relative to the printhead in the exit region of the print zone. In this arrangement, the platen supports the print material along a line of contact and effects a "reverse bow", or concavely, controlled curve in the print material throughout the print zone to ensure proper pen-to-print material spacing during printing. Due to the concave shape of the sheet relative to the edge on the inclined region, the sheet does not generally buckle upwardly at the line of contact on the edge. However, in the case of dense ink printing, the print material may tend to buckle upwardly toward the printhead and off the line of contact which may result in ink smearing. In addition, the amplitude of this upward buckling along the line of contact, perpendicular to the sheet direction of travel, may vary. For example, the amplitude of upward buckling may be greater at a center point of the line of contact than out at the sheet edges.

DISCLOSURE OF THE INVENTION

The invented print medium handling system represents an inexpensive solution to the problem of uncontrolled print medium bending upwardly toward the printhead in a print zone, the system thereby decreasing the possibility of ink smearing. The preferred embodiment includes a printhead for printing on a print medium, and a platen located generally adjacent the printhead such that the platen and the printhead define a print zone therebetween. The platen includes ribs on an upper surface thereof, the ribs being adapted for contacting a lower surface of the print medium such that the print medium bends downwardly between the ribs thereby reducing uncontrolled bending of the print medium in the print zone. Specifically, a first curvature is created in the sheet between the ribs and a feed mechanism, the first curvature creating controlled downward bending in the sheet. During high ink density printing some of this downward curvature stress must be relieved. This is accomplished by spacing the ribs an appropriate distance apart. The spacing of the ribs, and the stress in the sheet, forces the sheet into a second curvature downwardly between the ribs. This second curvature relieves some of the stress created by the first curvature, resulting in controlled bending of the print media during printing. Thus, the print medium, or print material, bends downwardly between the ribs instead of upwardly toward the printhead. In addition, the predetermined rib spacing evenly relieves stresses across the width of the sheet, leading to relatively even, controlled bending of the sheet along the line of contact between the sheet and the top surface of the ribs.

These and additional objects and advantages of the present invention will be more readily understood after a consideration of the drawings and the detailed description of the preferred embodiment.

DETAILED DESCRIPTION OF THE PREFERRED EMBODIMENT AND BEST MODE OF CARRYING OUT THE INVENTION

Figure 1:
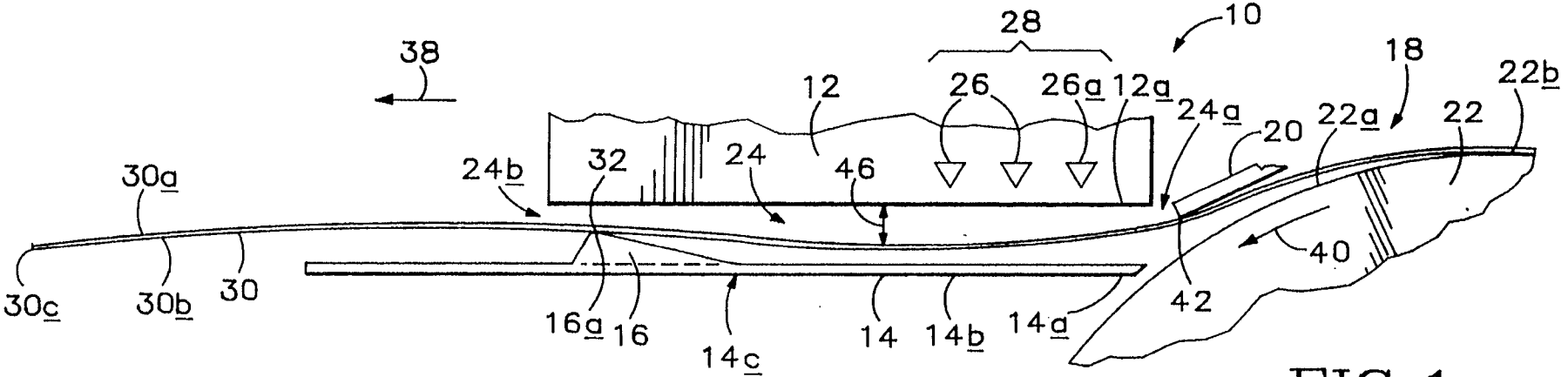
FIG. 1 shows the preferred embodiment of the print material handling system including cockle ribs, with a sheet of print material supported thereon.

FIG. 1 shows the print material handling system 10 of the preferred embodiment which includes a printhead 12 and a platen 14, the platen including cockle ribs 16. Print material handling system 10 may also be thought of as a printer mechanism, a print medium handling device or a print medium handling mechanism. Printhead 12 may also be referred to as a pen or an ink-jet printhead. Platen 14 is positioned generally adjacent printhead 12 such that a print zone 24 is defined therebetween. In the preferred embodiment, system 10 further includes a feed device, shown generally at 18. Feed device 18 typically includes a paper guide 20 and a drive roller 22. Printhead 12 typically includes one or more nozzles 26 which together comprise a printing array 28. In operation, nozzles 26 drop or eject ink droplets onto an upper surface 30*a* of a sheet of print material 30 positioned adjacent printhead 12. Sheet 30 further includes a lower surface 30*b* which generally contacts a top surface 16*a* of cockle ribs 16 along a rib line of contact 32 (more clearly shown in FIG. 4). Top surface 16*a* is typically a line of contact but may also be a point of contact on each rib 16 or a planar region of contact.

In another way of describing the invention, print medium handling device 10 comprises a pen 12 for printing on a print medium 30 and support structure 14 located generally adjacent the pen such that the print medium is positioned between the pen and the support structure during printing. Support structure 14 preferably includes upwardly extending projections 16 adapted to support print medium 30 in a controlled flexure during printing. Typically, projections 16 are spaced from one another thereby defining spaces 44 therebetween (shown in FIG. 4). Projections 16 allow the print medium to bend downwardly between the projections into spaces 44 to inhibit uncontrolled bending of the print medium during printing. Typically, projections 16 are aligned generally parallel to a direction of travel 38 of print medium 30. Preferably, the projections are fixed and are manufactured integral with platen 14. In another embodiment, the projections may be manufactured separately from platen 14 and thereafter attached to platen 14. In such a case, support structure 14 may further include a transition region **14*c*** adjacent the projections, the transition region adapted to facilitate movement of a leading edge of the print medium onto the projections.

Typically, printhead 12 is horizontally positioned such that nozzles 26 are located on an underside region **12*a* of printhead 12**. However, the printhead may be vertically arranged such that the nozzles are positioned on a side of the printhead wherein the sheet of print material is positioned adjacent the side of the printhead.

In operation, nozzles 26 drop or eject ink onto the upper surface **30*a*** of the sheet of print material. Typically, the ink includes a relatively large amount of water such that when the ink is placed on a sheet of print material, the ink saturates the fibers of the print material. This saturation causes the fibers to expand, which in turn causes buckling or cockling of the sheet material. For purposes of this invention, the sheet material may be mylar, paper, cardboard, envelope material or any such sheet material. The ink may be any liquid based wet-ink, or any other ink that causes sheet material buckling.

Figure 5:
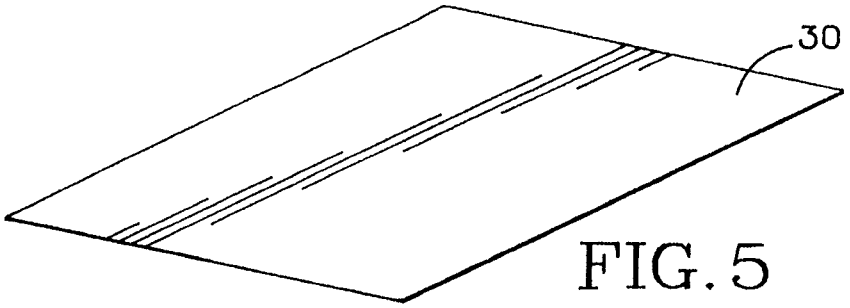
FIG. 5 shows a sheet of unprinted print material.

FIG. 5 shows an unprinted or a low ink density printed sheet of print material 30 in a flat configuration.

Figure 6:
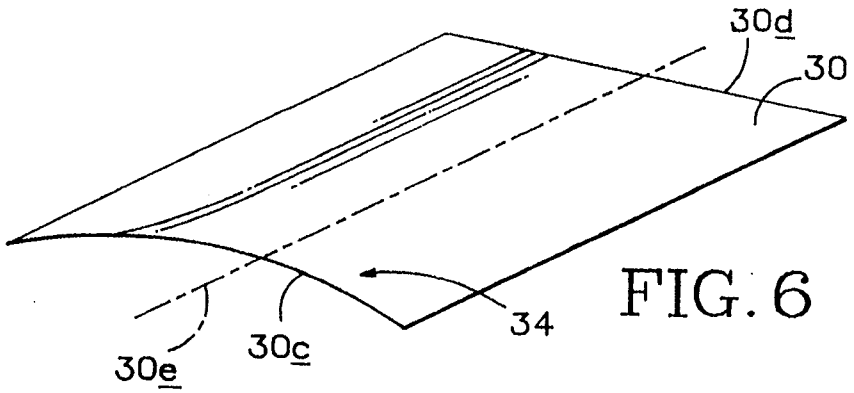
FIG. 6 shows a sheet of print material wherein the sheet has "U"-shaped bending.

FIG. 6 shows a printed-upon sheet 30 having a leading edge **30*c* which is downstream of trailing edge 30*d*. Sheet 30 is bent in a generally truncated cone shape 34 such that leading edge 30*c* has a generally inverted "U"-type shape. Truncated cone-type bending 34 is typically symmetrical about elongate axis 30*e* of sheet 30**.

Figure 7:
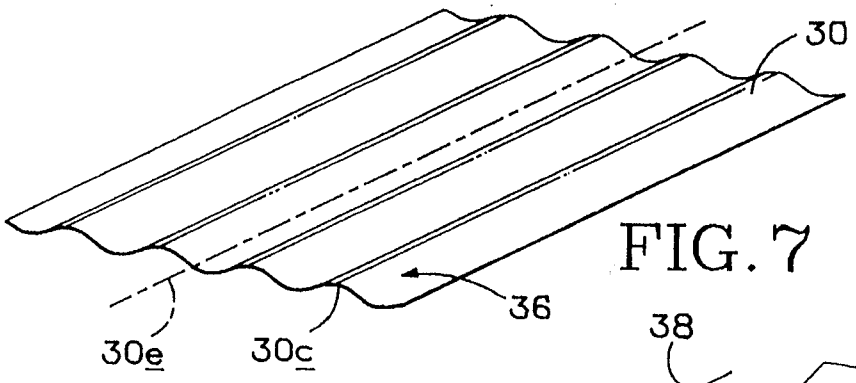
FIG. 7 shows a sheet of print material wherein the sheet has wave-shaped bending.

FIG. 7 shows a printed-upon sheet 30 bent in a wave-, or accordion-type shape 36. The wave-shaped bends 36 are generally parallel to elongate axis **30*e* such that leading edge 30*c*** is generally wave, or zig-zag, shaped.

Figure 8:
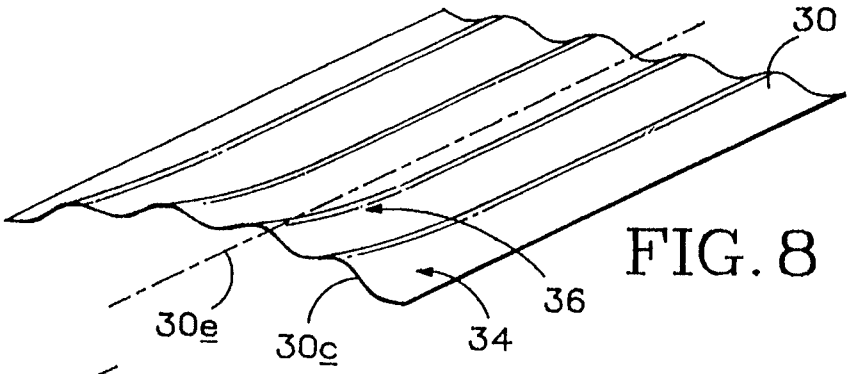
FIG. 8 shows a sheet of print material having "U"-type and wave-type bending.

FIG. 8 shows a printed-upon sheet 30 which includes truncated cone-type bending 34 and wave-type bending 36. Both types of bending are generally parallel to elongate axis **30*e* such that leading edge 30*c*** has a generally inverted "U"-type shape and a generally wave-type shape.

Figure 9:
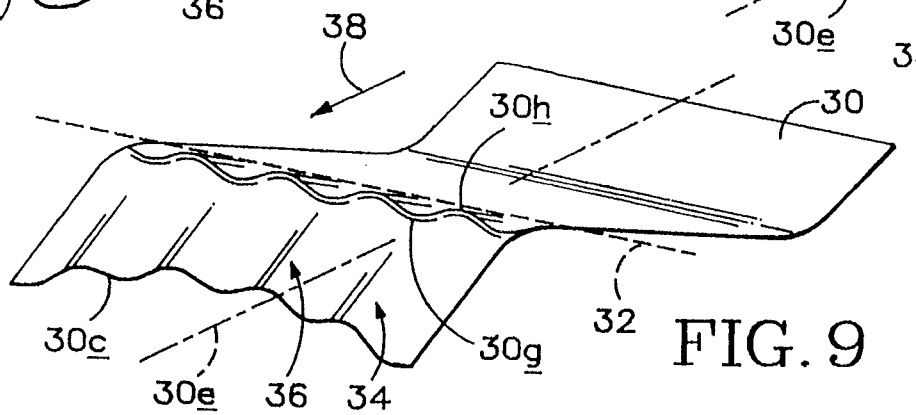
FIG. 9 shows the sheet of FIG. 8 as supported by cockle ribs such that the sheet material bends downwardly between the cockle ribs.

FIG. 9 shows sheet 30 having wave-type bending along rib line of contact 32 which represents the line created by top surfaces **16*a* of ribs 16. Specifically, the sheet bends downwardly, to form depressions 30*g*, between adjacent ribs 16. The highest point 30*h* of the wave-type bends contact and are supported by top surface 16*a* of ribs 16. Downstream of line of contact 32, sheet 30 may have wave-type bending 36 and "U"-type bending 34**.

Referring again to FIG. 1, in the preferred embodiment, feed mechanism 18 includes print material guide 20 and drive roller 22 (only a section of the drive roller is shown for clarity). The feed mechanism 18 is typically positioned adjacent the printer input port or entrance region **24*a* of print zone 24. In operation, drive roller 22 picks a sheet from an input tray containing a stack of sheet material (not shown) and feeds or advances the sheet in direction of travel 38 into print zone 24. Specifically, a sheet of print material 30 is picked from an input tray and held against the driver roller by pinch rollers (not shown) such that under surface 30*b* of sheet 30 contacts the outer surface 22*a* of roller 22 as the roller rotates in direction 40. The upper-most point 22*b* of roller 22 is typically positioned in a plane vertically above print zone 24 such that roller 22 conveys sheet 30 generally downwardly into print zone 24 and forwardly along feed direction, or feed axis, 38**.

Print material guide 20 contacts the upper surface **30*a* of the sheet and cooperates with drive roller 22 to bias the sheet downwardly into the print zone thereby ensuring that the sheet avoids contact with first nozzle 26*a*. Typically, an upstream end 14*a* of platen 14 is positioned generally adjacent drive roller 22 to prevent sheet 30 from continuing around drive roller 22 in direction 40**.

Figure 4:
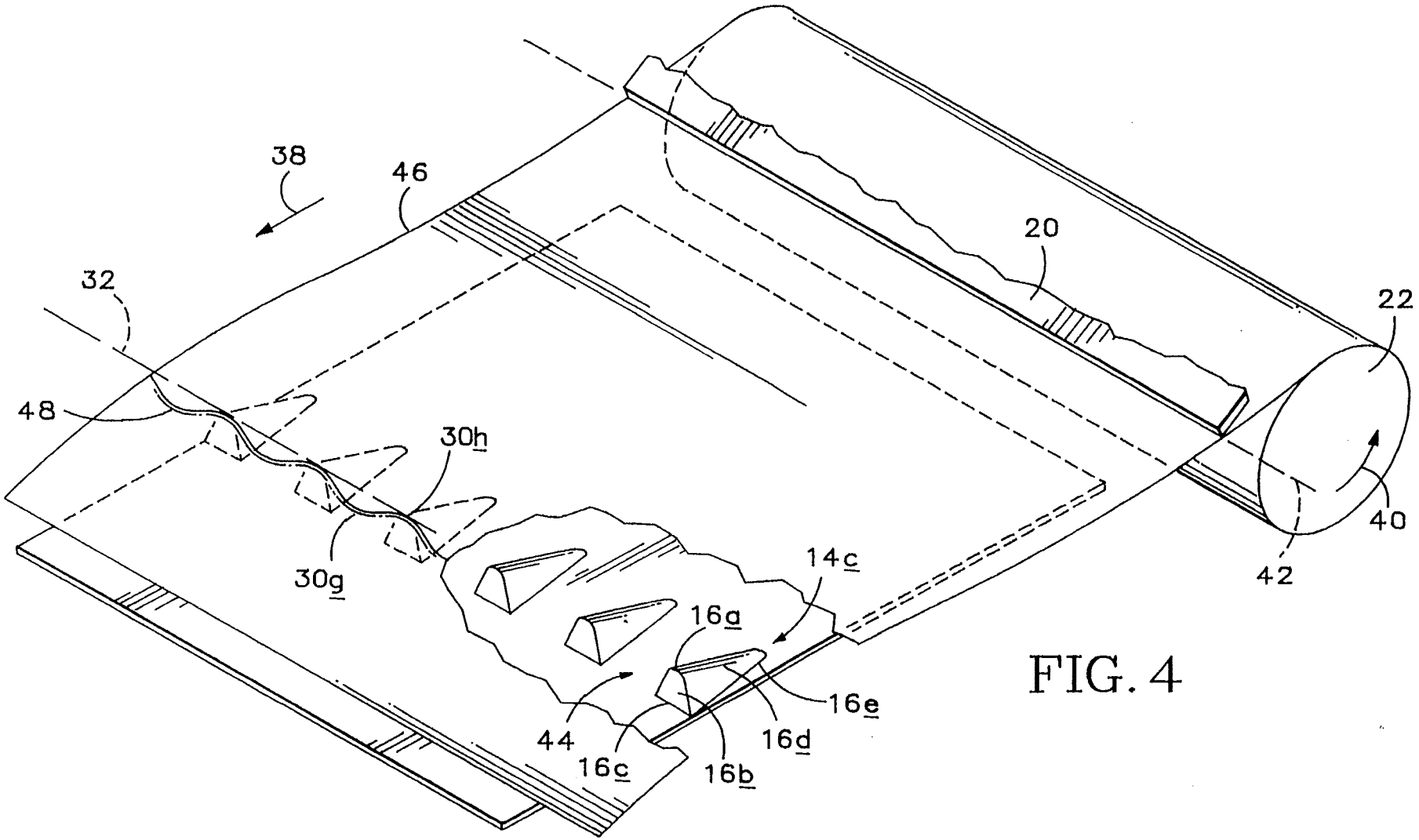
FIG. 4 shows a schematic isometric view of the preferred embodiment of the print material handling system including cockle ribs, a portion of the sheet of print material cut away to reveal the cockle ribs.

Still referring to FIG. 1, print material guide 20 generally contacts sheet 30 along a guide line, or region, of contact 42 (more clearly shown in FIG. 4). The guide, the roller and the platen cooperate to effect a concavely curved shape in the sheet, relative to drive roller 22, upstream of guide line of contact 42 and a generally concavely curved shape in the sheet, relative to printhead 12, downstream of guide line of contact 42. Thus, guide line of contact 42 defines a first line of inflection such that the sheet is concavely curved in one direction upstream of the line of inflection, and concavely curved in an opposite direction downstream of the line of inflection 42.

In the preferred embodiment, platen 14 includes a flat expanse **14*b* and a region of transition 14*c*, the region of transition being generally upstream of and adjacent to cockle ribs 16. Transition region 14*c* may also be referred to as a transition zone. Transition region 14*c*, in the preferred embodiment, is a smooth transition between flat region 14*b* and cockle ribs 16 such that as leading edge 30*c* of sheet material 30 is fed through print zone 24, leading edge 30*c* makes a smooth transition from flat region 14*b* of platen 14 up onto cockle ribs 16. Preferably cockle ribs 16 and platen 14 are manufactured as an integral unit with transition zone 14*c* being a smooth curve. In another embodiment, wherein ribs 16 are attached to flat region 14*b*, transition region 14*c* may be a slight projection or bump which prevents leading edge 30*c* from becoming caught on the attachment or on a lower region of cockle ribs 16. Specifically, cockle ribs 16 may be attached by screws or the like to platen 14. In such a case, transition region 14*c* may include a ridge which allows leading edge 30*c* to move smoothly over the screws onto cockle ribs 16**.

In use, leading edge **30*c* of a sheet 30 is conveyed by feed mechanism 18 into print zone 24. During this initial stage of sheet feeding, leading edge 30*c* is typically supported by flat region 14*b*. Due to the position of drive roller 22 generally above platen 14, sheet 30 is generally concavely curved relative to printhead 12 in print zone entrance region 24***a*. As sheet 30 is conveyed through print zone 24, leading edge 30*c* moves in direction of travel 38 along platen 14. Uncontrolled bending typically does not occur in this initial stage of printing because all the nozzles of printing array 28 have not yet printed on sheet 30.

Still referring to FIG. 1, as feed mechanism 18 further conveys sheet 30 in direction 38, leading edge 30*c* moves through transition zone 14*c* and contacts cockle ribs 16. As leading edge 30*c* is further conveyed in direction 38, leading edge 30*c* passes over the top surface 16*a* of the cockle ribs such that cockle ribs 16 contact underside 30*b* along a line of contact 32 (more clearly shown in FIG. 4). Thus, sheet 30 is suspended in a first curvature 46 between feed mechanism 18 and top surface 16*a* of cockle ribs 16. In this manner, cockle ribs 16 and feed mechanism 18 effect a generally concave shape 46 in the sheet relative to printhead 12 in a portion of the sheet which is upstream of top surface 16*a*.

Referring to FIG. 4, during this stage of printing, pens 26 of array 28 print ink on upper surface 30*a* of the sheet of print material. As more ink is printed on sheet 30, the sheet tends to cockle or bend. Due to the spacing of cockle ribs 16, the stresses in the sheet which are created by first curvature 46 are relieved as sheet 30 cockles downwardly into spaces 44 defined by the cockle ribs.

Cockle ribs 16 are typically wedge-shaped members which extend generally parallel to the sheet direction of travel 38. Ribs 16 typically include a top surface 16*a* which may be a point or a flat plateau, but which is preferably a curved line. Ribs 16 typically taper downwardly away from top surface 16*a* in direction of feed 38. This downwardly extending downstream surface 16*b* widens as it approaches the generally flat region of platen 14 such that downstream surface 16*b* is wider along lower edge 16*c* than along top edge 16*a*. Cockle ribs 16 also include a sheet contacting, or inclined surface 16*d* which extends downwardly toward flat region 14*b* and in the opposite direction of sheet travel 38. Sheet contacting surface 16*d* may also be referred to as an inclined surface. Typically, sheet contacting surface 16*d* is a rounded inclined surface which contacts flat region 14*b* along a curve 16*e*. Typically, ribs 16 are 2 mm in height, measured from the surface of flat region 14*b* upwardly to top surface 16*a* of rib 16. The ribs are typically 2 mm wide measured along top surface 16*a* and are typically 4 mm wide measured along lower edge 16*c*. Typically, ribs 16 are 8 mm in length measured along direction of travel 38. In the preferred embodiment, the ribs are spaced 11 mm apart, measured from the center point of one rib to the center point of an adjacent rib. However, the ribs may be spaced in the range of 5 to 20 mm apart.

Still referring to FIG. 4, top surface 16*a* of ribs 16 suspend the sheet such that ribs 16 and feed mechanism 18 create a first curvature, or flexure, 46 in the sheet between the ribs and the feed mechanism. First curvature 46 produces a stress within the sheet which tends to inhibit upward buckling during low density ink printing by forcing the sheet to bend downwardly between rib line of contact 32 and guide line of contact 42. However, when the printer is printing somewhat larger areas of dense ink, this first curvature creates additional stress in the sheet which may not reduce buckling to an acceptable level. By "acceptable level", applicants mean that the pen-to-print medium spacing must be close enough to ensure high quality printing, while spaced a distance appropriate to prevent ink smearing due to sheet upward buckling during high density ink printing. In such dense ink printing situations, a second curvature must be created in the sheet to relieve this additional stress and reduce upward buckling which may result in sheet contact with ink nozzles 26.

The additional stress of this dense ink printing is relieved by a second curvature 48, namely, the sheet buckling downwardly between ribs 16 into spaces 44 defined by adjacent ribs 16. Second curvature 48 is actually a series of curves in sheet 30 along rib line of contact 32. The desired frequency of this second curvature in a typical sheet of paper, and thereby the desired stress relief, is achieved when the ribs are spaced 11 mm apart. Other rib spacing may be used for other types of sheet material or for other periodic curvature, or wave, frequencies, to achieve the desired stress relief due to second curvature 48.

Now describing second curvature 48 in more detail, sheet underside 30*b* contacts and is supported by ribs 16 along top surface 16*a* while the sheet is unsupported between the ribs in spaces 44. Top surfaces 16*a* are preferably concavely curved downwardly. Due to gravity, and in response to the stress created by first curvature 46, the unprinted sheet, or light ink density printed sheet, tends to bend slightly below the plane defined by top surfaces 16*a*, conforming to the shape of curved top surfaces 16*a*. During high density ink printing, the large amount of ink absorbed by the sheet expands the sheet fibers, causing additional stress in the sheet. To relieve this stress, the sheet tends to bend, enlarging the slight curvature already created in the sheet by curved top surfaces 16*a*. Thus, the slight curvature downwardly into spaces 44 is increased into larger downwardly extending curves as high ink density printing occurs. This downward, or second, curvature 48 is directed away from printhead 12, thereby avoiding the problems associated with ink smearing while maintaining an appropriate pen-to-print medium spacing in the print zone during printing. In addition, second curvature 48 creates a concave shape in sheet 30 about top surfaces 16*a* to force even downward controlled bending along line of contact 32 such that curves 48 along line of contact 32 have generally the same amplitude.

Thus, applicants' system avoids problems of prior art platens which prohibit sheet bending downwardly below the sheet support surface. In addition, applicants' system tends to create even downward controlled bending of sheet 30 along rib line of contact 32 (shown in FIG. 4), avoiding cone-type bending along line 32. Due to the relatively regular frequency of bending along line 32, any upward bending toward pens 26 which may occur will not likely lead to ink smearing because its amplitude will be small in comparison to one large cone-type bend 34. For these reasons, the pen-to-print medium spacing 46 of system 10 may be smaller than in prior art printers which must allow for worst-case upward cockle growth of sheet 30 toward pens 26.

Typically, cockle ribs 16 are positioned downstream of printing array 28 and preferably are positioned in an exit region 24*b* of print zone 24. In this position, ribs 16 contact sheet 30 downstream from paper guide 20, which provides a well-defined amount of stress in sheet 30 to force the desired frequency and downward cockle direction of the first curvature 46. Positioning of ribs 16 closer to paper guide 20 may result in unnecessary stress in the first curvature, and therefore unnecessary bending, in sheet 30. This unnecessary stress may have adverse effects, including creating unwanted bending in the sheet between ribs 16 and paper guide 20, during low ink density printing. In addition, positioning ribs 16 generally adjacent pen array 28 may add unnecessary resistance to sheet feeding. However, if such adjacent rib positioning is desired, such resistance could be avoided by appropriate spacing of ribs 16 from one another to relieve the resistance.

Still referring to FIG. 4, the generally wedge shape of ribs 16 acts as a cockle growth barrier, preventing cockles which form downstream of rib line of contact 32 from propagating upstream of the rib line of contact 32 and under print array 28. Ribs 16 create this upstream cockle barrier effect because top surface 16*a* supports the underside 30*b* while gravity and the sheet's own tendency to relieve stress forces the paper downwardly on either side of ribs 16 creating a concave curvature of sheet 30 about top surface 16*a*.

Figure 2:
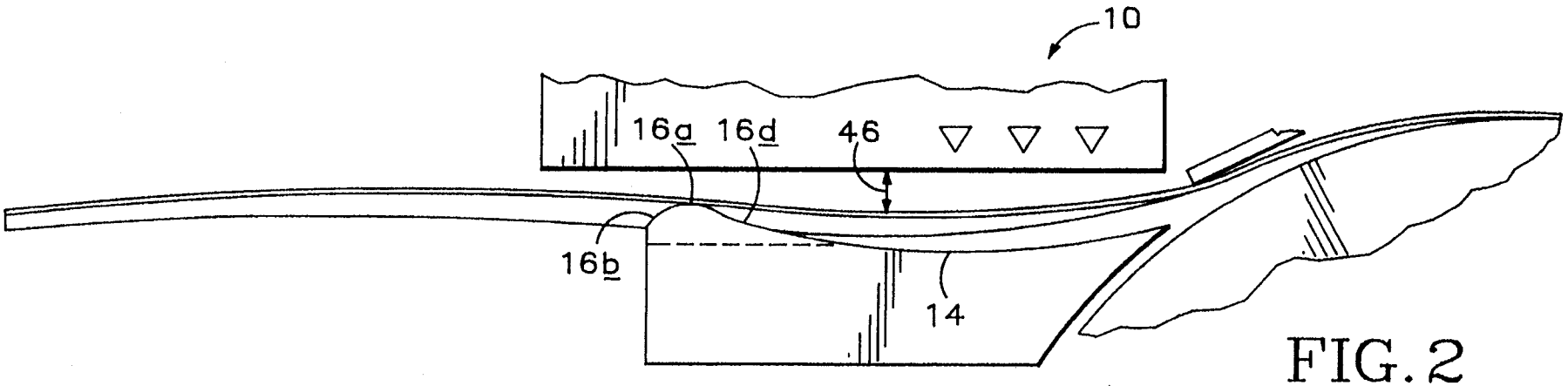
FIG. 2 shows a second embodiment of the print material handling system including cockle ribs, with a sheet of print material cockling downwardly between the ribs.

As shown in FIG. 2, ribs 16 may include a rounded inclined surface 16*d* which tapers into a rounded back surface 16*b*.

Figure 3:
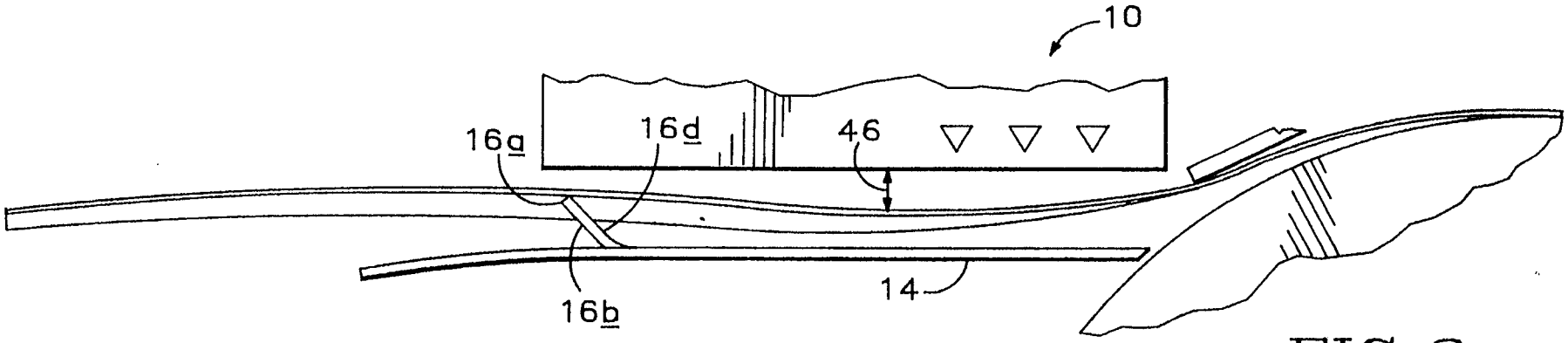
FIG. 3 shows a third embodiment of the print material handling system including cockle ribs, with a sheet of print material cockling downwardly between the ribs.

As shown in FIG. 3, ribs 16 may comprise upwardly extending projections having a flat inclined surface 16*d* and a flat inclined back surface 16*b* generally parallel with flat inclined surface 16*d*.

Industrial Applicability

It may be seen that the invented apparatus 10 ensures proper printhead-to-print material spacing 46 by reducing uncontrolled bending of print material 30 in a print zone 24 through use of a platen 14 which contacts the sheet material 30 generally along a rib line of contact 32, and which allows the sheet to bend downwardly between upwardly extending ribs 16. The inventive platen reduces uncontrolled bending of print material in the print zone without the incorporation of an expensive and complex second drive roller while decreasing the risk of ink smearing due to printhead-print material contact. The print material handling system 10, which includes a platen 14 with raised ribs 16, uses the print material's own elasticity and stress-relieving properties to effect a controlled first curvature in the print material between the ribs and a guide mechanism, and a controlled second curvature between the ribs themselves, to achieve a relatively small printhead-to-print medium spacing 46.

While the present invention has been shown and described with reference to the foregoing preferred embodiment, it will be apparent to those skilled in the art that other changes in form and detail may be made therein without departing from the spirit and scope of the invention as defined in the appended claims.

We claim:

1. A printer mechanism adapted to control pen-to-print medium spacing during printing, the mechanism comprising:

a printhead for printing on a print medium, and a platen located generally adjacent the printhead such that the platen and the printhead define a print zone therebetween, the platen including a plurality of elongate ribs which project from an upper surface of the platen in spaced relationship and positioned to contact a lower surface of the print medium such that the print medium bends downwardly between the ribs to provide an undulated section of the print medium, thereby reducing uncontrolled bending of the print medium in the print zone.

2. The printer mechanism of claim 1 wherein each rib extends substantially parallel to a direction of travel of the print medium through the print zone.

3. The printer mechanism of claim 1 wherein each rib includes an inclined surface terminating in a top surface, the inclined surface being adapted to facilitate movement of the print medium's leading edge along the inclined surface and over the top surface.

4. The printer mechanism of claim 1 wherein the ribs are configured for contacting the print medium along a line of contact in the print zone, the line of contact being substantially perpendicular to a feed direction of the print medium, and the line of contact adapted to effect a concave flexure in the print medium relative to the printhead generally throughout the print zone, thereby reducing uncontrolled bending of the print medium in the print zone.

5. A print medium handling device for a printer having an ink-jet pen, the device comprising:

a pen adapted for printing on a print medium; and support structure located adjacent the pen such that print medium is positioned between the pen and the support structure during printing, the support structure including multiple upwardly extending spaced projections to provide an undulated section of the print medium and support the print medium in a controlled flexure during printing.

6. The device of claim 5 wherein the projections are aligned in a row which extends substantially perpendicular to a direction of travel of the print medium.

7. A print medium handling mechanism for a printer having an ink-jet printhead, the mechanism comprising:

a printhead adapted for printing on a print medium; and a support surface located adjacent the printhead, the support surface including fixed projections, the projections structured to contact the print medium along a line of contact substantially perpendicular to a direction of travel of the print medium, the projections being spaced from one another such that the projections suspend the print medium between the projections along the line of contact.

8. The mechanism of claim 7 wherein the projections are aligned in a row which extends substantially perpendicular to a direction of travel of the print medium.

9. The mechanism of claim 7 wherein the projections include an inclined surface terminating in a top surface, the inclined surface adapted to facilitate movement of the print medium's leading edge along the inclined surface and over the top surface.

* * * * *